United States Patent [19]

Miyake et al.

[11] 4,052,018

[45] Oct. 4, 1977

[54] METHOD AND APPARATUS FOR COUNTING YARN-SPLICING FREQUENCIES OF SPINDLES IN AUTOMATIC WINDING MACHINE

[75] Inventors: Takao Miyake, Neyagawi; Katsue Koashi, Toyonaka; Masato Sawada, Amagasaki, all of Japan

[73] Assignee: Kurashiki Boseki Kabushiki Kaisha, Japan

[21] Appl. No.: 735,415

[22] Filed: Oct. 26, 1976

[30] Foreign Application Priority Data

Feb. 13, 1976 Japan ..... 51-15035

[51] Int. Cl.[2] ..... B65H 63/00; B65H 54/02; B65H 69/04

[52] U.S. Cl. ..... 242/36; 242/35.5 R; 242/35.6 R; 242/37 R

[58] Field of Search ..... 242/36, 35.5 R, 35.6 R, 242/37 R; 28/64

[56] References Cited

U.S. PATENT DOCUMENTS

| | | | |
|---|---|---|---|
| 1,905,259 | 4/1933 | Abbott | 242/36 |
| 2,714,491 | 8/1955 | Hilbert | 242/37 R |
| 2,752,103 | 6/1956 | Furst | 242/36 |
| 2,961,178 | 11/1960 | Chambley | 242/35.6 R |
| 3,345,004 | 10/1967 | Livingston | 242/35.5 R |
| 3,939,633 | 2/1976 | Lossa | 242/35.6 R |

*Primary Examiner*—Edward J. McCarthy
*Attorney, Agent, or Firm*—Wenderoth, Lind & Ponack

[57] ABSTRACT

A method and apparatus for counting yarn splicing operations due to normal and abnormal reasons for each of the spindles in an automatic winding machine provided with a plurality of winding spindles each having associated therewith a slub catcher and bobbin replacing means, and an automatic knotting machine circulating past the spindles for carrying out yarn splicing at each of said spindles when necessary. A yarn splicing operation at each spindle is detected by a yarn splicing detecting means including a reed switch associated with each spindle for producing a yarn splicing detecting signal when closed for longer than a predetermined time, and a magnet secured to the automatic knotting machine operates the respective reed switches. Yarn cutting at each spindle is detected by a yarn splicing detecting means including a reed switch associated with each spindle for producing a yarn splicing detecting signal when closed for longer than a predetermined time, and a magnet secured to the automatic knotting machine operates the respective reed switches. Yarn cutting at each spindle is detected by a yarn cutting detecting means which detects the operation of the slub catcher for the spindle and produces a yarn cutting detecting signal. Bobbin replacement is detected by a detecting means which produces a bobbin replacement signal when bobbin discharge occurs simultaneously with the yarn splicing detecting signal. A data processor counts the operations for the respective spindles and compares them for determining the number of splicing operations for the respective spindles due to causes other than spindle replacement and yarn cutting by the slub catchers.

6 Claims, 9 Drawing Figures

METHOD AND APPARATUS FOR COUNTING YARN-SPLICING FREQUENCIES OF SPINDLES IN AUTOMATIC WINDING MACHINE

The present invention relates to a method and an apparatus for counting, spindle by spindle, the number of yarn splicing operations, that is, yarn splicing frequencies of spindles in an automatic winding machine provided with an automatic knotting machine in order to detect quickly abnormal yarns and spindles requiring maintenance and to analyze the reasons for splicing for each spindle to provide a single-spindle monitoring operation.

In this type of automatic winding machine, various monitoring apparatuses are used to monitor the yarn splicings for controlling and maintaining the operations of the machine. However, this type of conventional apparatus does not provide sufficient information to perform effective monitoring operations spindle by spindle, or requires an extensive system to obtain sufficient information for such monitoring.

The present invention is provided to overcome the disadvantages of the conventional apparatus. It is a basic object of the present invention to identify, spindle by spindle, so-called unavoidable and normal means for yarn splicing such as those due to bobbin replacement and inferior yarn quality and distinguished them from so-called abnormal reasons for yarn splicing such as those due to the poor maintenance resulting in inferior mechanical operation, etc., to perform effective single-spindle monitoring from a central control location, through a simple construction, so as to result in early detection of spindles requiring maintenance, abnormal yarn, abnormal operation of the slub catcher, etc.

According to the monitoring method in accordance with the present invention, the total member of the yarn splicings, the number of bobbin replacements, and the number of yarn breaks due to the yarn quality or an abnormal operation of the slub catcher are counted respectively, spindle by spindle, the frequency of the yarn-splicing operations which are for normal yarn-splicing reasons and which are for abnormal yarn-splicing reasons being detected from these counted values, inferior yarn or an inferior slub catcher being indicated when the number of the yarn splicings of the former type increases and inferior operation of the winding spindle being indicated when the number of the yarn splicings of the latter type increases. Thus, maintenance monitoring can be effected without difficulty for each winding spindle, thus resulting in improved efficiency and quality control due to superior maintenance.

The monitoring apparatus of the present invention fundamentally comprises a yarn splicing detecting means for detecting the number of the yarn splicing for each spindle and independently of the reasons therefor, a yarn break detecting means for detecting, for each spindle a yarn break by cooperation with the operation of the slub catcher, a bobbin replacement detecting means for detecting, for each spindle, the replacement of the bobbins, and a counting means for counting the detection signals inputted from the each detection means, respectively.

The yarn splicing detecting means for the present invention comprises a magnet secured to a knotting machine, which travels past each winding spindle of the automatic winding machine in regular sequence to automatically effect a necessary yarn splicing operation, and reed switches provided, respectively, on each winding spindle, and the yarn splicing detecting means is adapted to discriminate the mere passing by the spindle from a yarn splicing operation by the length of time each reed switch is operated by the magnet.

The yarn detecting means of the present invention is a means for detecting spindle by spindle, the operation of a slub catcher (or called a yarn cleaner, clearer, etc.) which controls the yarn quality of each winding spindle to cut the yarn when the yarn quality is inferior, and detects the operation of each slub catcher electrically and produced an output in response thereto.

The bobbin replacement detecting means of the present invention can be a means wich detects the opening operation of the bobbin shutter optically and produces a detection signal, or a means which detects the replacing of the bobbin mechanically or electrically and produces a detection signal. The bobbin replacement detecting means is not always required to detect replacement spindle by spindle. The spindle at which a bobbin has been replaced can be determined by detection of the spindle for which the bobbin replacement detecting signal and the yarn splicing detecting signal are synchronized, since the spindle at which yarn splicing has been effected is detected by the yarn splicing detecting means.

The counting means of the present invention is a means which respectively counts, spindle by spindle, the individual detecting signals received thereby. As described hereinabove, the number of so-called abnormal yarn splicing operations can be detected for the respective spindles by subtracting the sum of the yarn breaks and the bobbin replacement from the total number of the yarn splicing operations counted by the counting means.

With the monitoring apparatus of the present invention, the occurrence of a yarn splicing operation can be detected by the time difference between the time for the mere passing of the knotting machine by a spindle and the time for carrying out a yarn splicing, and the number of the winding spindle at which a yarn splicing operation is being effected can be read to remarkably simplify detecting the spindle at which yarn break or bobbin replacement is occurring. Easier incorporation thereof into the type of automatic winding machine employed at present and easier setting of the data processing device are also ensured. Accordingly, the apparatus is not required to have a large size. Therefore, an extremely efficient monitoring apparatus can be provided.

These and other objects and features of the present invention will become apparent from the following description taken in conjunction with the preferred embodiment thereof withe reference to the attached drawings in which.

Figure 1:
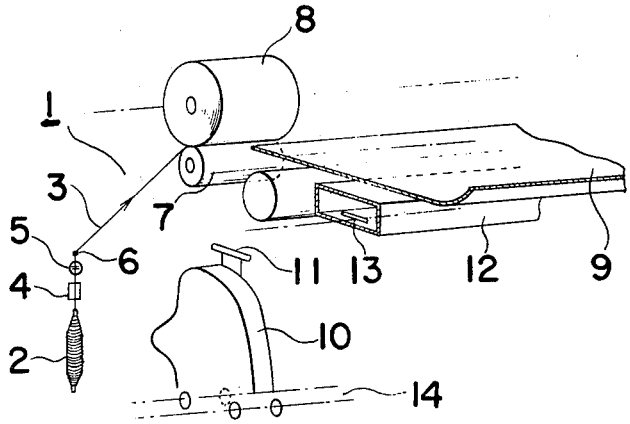
FIG. 1 is a schematic perspective view showing the essential parts associated with one winding spindle of an automatic winding machine.

Referring now to FIG. 1, there are shown a winding spindle 1 of an automatic winding machine having conventional components and structure, in which a spun yarn 3 unwound from a bobbin 2 is wound up on a cheese 8, by means of a driving drum 7, through an unwinding controller 4, a tension regulator 5 and a slub catcher 6 in a known manner and the fully-wound cheese is adapted to be placed on a deposit shelf 9, and a knotting machine 10 of a known type which is always driven to pass along the spindles of one group of said winding spindles and to occasionally stop and splice the yarn for the respective winding spindle 1 which has been cut due for one reason or another. A magnet 11 is secured on the top of the knotting machine, while a reed switch 13 is provided in front of each of said winding spindles. The reed switch 13, which is operated by the magnet 11 is disposed, for each winding spindle 1, within a duct 12 of non-magnetic material which is provided under the deposit shelf 9 in the travelling direction of the knotting machine 10. The reed switch 13 operates to detect whether or not the knotting machine 10 simply passes by the spindle or whether or not it stops to carry out a yarn splicing operation.

Figure 2:
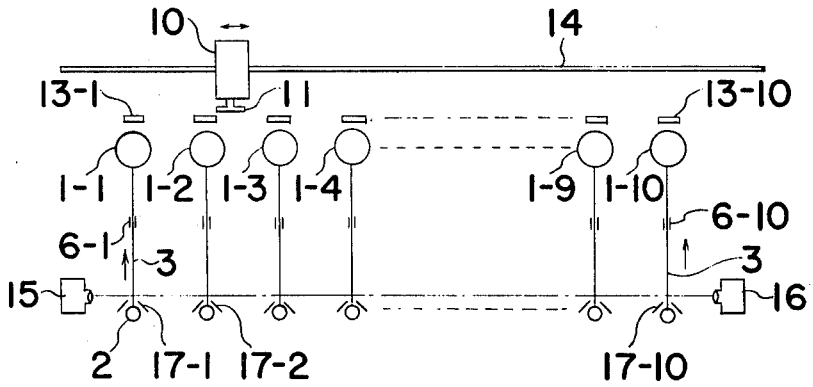
FIG. 2 is a diagrammatic view showing, for one section of an automatic winding machine, the construction of one embodiment in accordance with the present invention.

As shown in FIG. 2, one arrangement in the winding machine has, for instance, spindles disposed on a straight line at regular intervals so as to constitute one section. The knotting machine 10 is driven so as to reciprocate along a travelling track 14 for each section. Upon detecting that a winding spindle requires a yarn splicing operation, the knotting machine stops to perform the yarn splicing operation.

In order to detect the replacement of the bobbin 2 for the respective winding spindles 1-1, . . . 1-10, a light projector 15 is disposed at one end of the section, and a light receiver 16 is positioned at the other end to receive light therefrom. When any one of the bobbin shutters 17-1, . . . 17-10 of the respective winding spindles is opened, the light coming from the projector 15 towards the light receiver 16 is intercepted by the open bobbin shutter and the light receiver 16 will detect this electrically.

Figure 3:
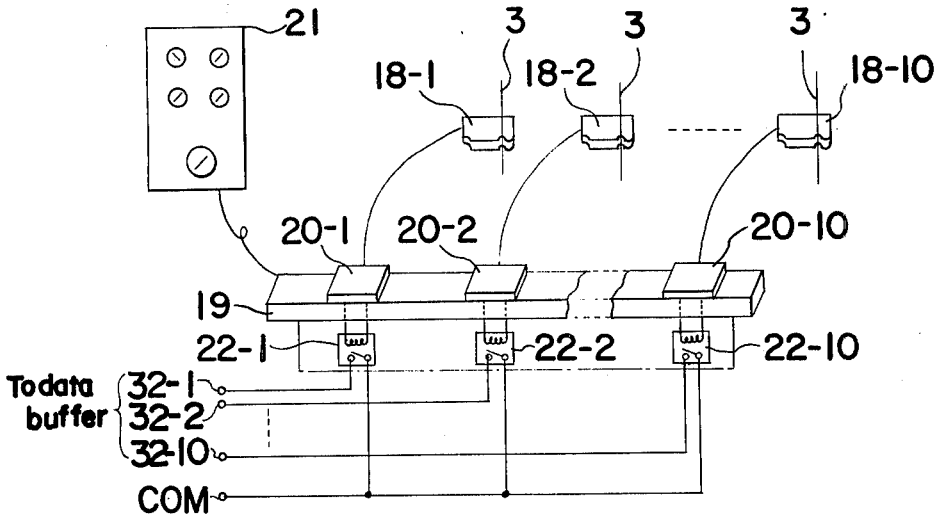
FIG. 3 is a schematic perspective view showing the detecting means for detecting the cutting operation of a slub catcher in accordance with the present invention.

Also, each of the slub catchers 6-1, . . . 6-10, has such known portions as a yarn-quality detecting portion, and a cutter for cutting the yarn incorporated or juxtaposed in the heads 18-1, . . . 18-10, as shown in FIG. 3, respectively. Each of heads 18-1, . . . 18-10 are electrically connected to a control unit 21, respectively, through the respective slub catcher amplifiers 20-1, . . . 20-10, which are disposed on a common plate 19 respectively. The control unit 21 detects whether or not the quality of the yarn is good in accordance with the type, diameter, etc. of the yarn through a yarn quality detection signal which is used to apply a cutting order to a corresponding head of the heads 18-1, . . . 18-10 when the quality of the yarn at the respective head is inferior thereby cutting the yarn by means of the cutter. In order to detect the operation of the cutter, reed relays for cut detection 22-1, . . . 22-10 are provided, respectively, in parallel to a cutter operating relay (not shown) incorporated in the corresponding amplifier so that a cut-detection signal can be obtained for each winding spindle 1-1, . . . 1-10 through a signal supplied to a corresponding cut-detecting reed relay 22.

A processing circuit for processing the detection signals from each of the detecting means including the reed switches 13, reed relays 22 and light receiver 16 will be described hereinafter.

Figure 4:
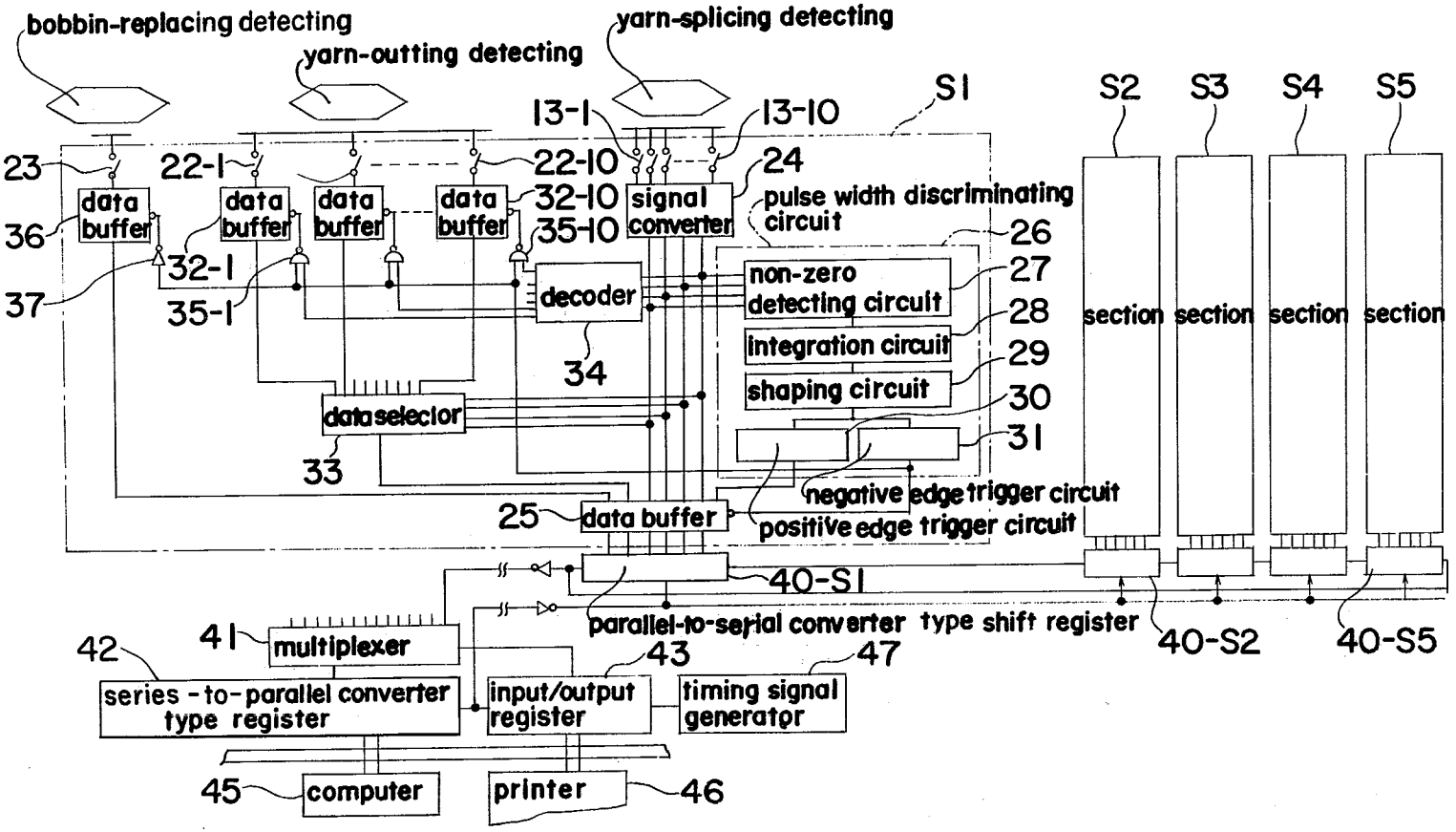
FIG. 4 is a block diagram of a data processing device in accordance with the present invention.

Referring to FIG. 4, a large block surrounded by one-dot chain line designates a processing circuit S1 for one section composed by ten spindles. Normally, five sections constitute one unit of an automatic winding machine, which is not shown completely. A plurality of similar processing circuits S2, . . . S5 are combined to form the processing circuit for the entire automatic winding machine.

Referring to the processing circuit for the section S1, the switches 13-1, . . . 13-10 are knotting detecting reed switches operated by the magnet 11 of the knotting machine 10 as described before, the relays 22-1, . . . 22-10 being the yarn splicing detecting reed relays. There is provided a photoelectric switch 23 in the light receiver 16. Each of the switches or relays is a type which turns on during operation.

The terminals on one side of the yarn splicing detecting reed switches 13-1, . . . 13-10 are connected in common, while the terminals on the opposite side are individually connected to a signal converter 24. The signal converter 24 produces a binary-coded-decimal code signal (hereinafter referred to as a BCD code signal) in accordance with the number of the winding spindle corresponding to the reed switch when a signal which indicates the knotting machine 10 has passed the spindle or has stopped thereat for yarn splicing is supplied thereto. The BCD code signal of the converter 24 is supplied to the data buffer 25 which has a six-bit input and is supplied to a pulse width discriminating circuit 26 for setting and for resetting the data buffer 25.

The pulse width discriminating circuit 26 comprises a non-zero detecting circuit 27; an integrating circuit 28; a shaping circuit 29; an positive edge trigger circuit 30 for detecting the leading edge of the square wave output of the shaping circuit 29; and negative edge trigger circuit 31 for detecting the trailing edge and the time constant of the integration circuit 28 has been determined properly to discriminate between whether the knotting machine 10 has simply passed the spindle or has stopped for splicing the yarn. This time constant is set to accommodate a period longer than a time of, for example, approximately 0.5 seconds required for the knotting machine 10 to simply pass the spindle, and a period of, for example, three seconds shorter than a time of 5 seconds required for the yarn splicing. The positive edge trigger circuit 30 detects the leading edge of the square wave output from the shaping circuit 29 and applies a set signal to the data buffer 25, while the negative edge trigger circuit 31 applies a reset signal, which corresponds to the termination of the yarn splicing, to the data buffer 25 to reset the data buffer 25.

On the other hand, the signals of the yarn splicing detecting reed relays 22-1, . . . 22-10 are supplied as input to the corresponding individual data buffers 32-1, . . . 32-10, and each of the data buffers 32-1, . . . 32-10 supplies its output to a data selector 33.

The reset terminals of data buffers 32-1, . . . 32-10 are connected, respectively, to the corresponding output terminals of the decoder 34 which supplies a signal to the corresponding reed switch, through the individual NAND gates 35-1, . . . 35-10 for resetting the data buffers by the negative edge trigger pulse of the circuit 31. Also, the data selector 33 reads the corresponding number of the winding spindle from the BCD code signal of the signal converter 24 and produces a yarn cutting detecting signal which is applied to one input terminal of the data buffer 25, when the number of the winding spindle is the same as the number of the winding spindle corresponding to a yarn cutting detecting signal.

As described hereinabove, the signal from the photoelectric switch 23 which is turned on when one of the bobbin shutters have been opened is supplied to the data buffer 36, which is reset each time an output signal of the negative edge trigger circuit 31 is produced and a detection signal is supplied to another input terminal of the data buffer 25.

The processing system for the detection signals including a yarn splicing detecting signal, yarn cutting detecting signal and bobbin replacing detecting signal, which are held in each section S1 to S5 will be described hereinafter.

As shown in, for example, the section S1, means 40-S1 to 40-S5 are parallel-to-serial converter type shift registers, respectively. Also, there is provided a multiplexer 41 which extracts said signal from a parallel-to-serial converter type shift register 40, in multiplexing manner in accordance with a selected winding machine number code, and a serial-to-parallel converter type shift register 42 which converts, into parallel, the series code signal coming from the multiplexer 41. In addition, there are provided an input register 43 of the data processor, to which the code signals of the serial-to-parallel converter type shift register 42 are supplied as input, and a computer 45, to which the data of the shift register 42 is supplied as input so as to perform the data processing necessary in accordance with the input data. A control signal coming from a timing signal generator 47 controls the loading and sending timings for the serial-to-parallel converter type shift register 42 and the parallel-to-serial converter type shift registers 40-S1, ... 40-S5 provided for each section S1 to S5.

The counting of yarn splicing, yarn cutting and bobbin replacement operations by the above circuit will be described hereinafter.

Figure 5:
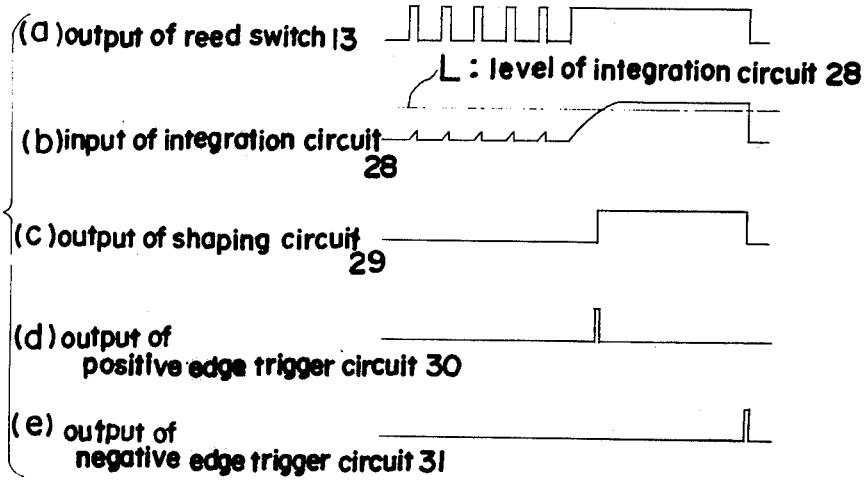
FIGS. 5(*a*) to (*e*) show timing signal charts each indicating the operation of a pulse width discriminating circuit for the data processing device shown in FIG. 4.

I. detection of yarn splicing;

Each of the yarn splicing detecting reed switches 13-1, ... 13-10 generates an output for about 0.1 second during the simple passing of the knotting machine by the corresponding spindles, or an output for about five seconds when yarn splicing takes place, as shown in FIG. 5(*a*), depending on whether the knotting machine 10 simply passes the spindle or stops for splicing of the yarn. The output from each of the reed switches 13-1, ... 13-10 is converted into a BCD code signal by the signal converter 24 and thereafter is supplied as input to the pulse width discriminating circuit 26. The BCD code signal which was supplied is supplied to the integration circuit 28 through a non-zero detecting circuit 27 and is integrated by means of the integration circuit 28 as shown in FIG. 5(*b*). When the knotting machine merely passes the spindles, the integral value does not reach a level L which has been set in the integration circuit 28, but exceeds the level L due to the continuous output from the reed switch for a winding spindle at which yarn is being spliced.

The output of the integration circuit 28 causes square pulses to be produced by the shaping circuit 29 as shown in FIG. 5(*c*). The positive edge trigger circuit 30 detects the leading edge of the square pulse and produces a set signal as shown in FIG. 5(*d*) thereby to set the data buffer 25. The data buffer 25 holds the number of the winding spindle at which the yarn is being spliced as a BCD code signal. The data buffer 25 which holds the BCD signal is reset after completion of each yarn splicing by a reset signal from the negative edge trigger circuit 31 as shown in FIG. 5(*e*).

II. detection of yarn cutting;

The yarn cutting detecting reed relays 22-1, ... 22-10 which are in the slub catchers of the winding spindles, respectively, are turned on upon operation of each slub catcher and set the corresponding data-buffers 32-1, ... 32-10 to supply input therefrm to the corresponding input terminals of the data selector 33 through the data buffers 32-1, ... 32-10. Each of data buffers 32-1, ... 32-10 corresponding to the BCD code signal from the decoder 34 is reset by negative edge trigger pulse. The data selector 33 supplies a yarn cutting detecting signal to the data buffer when the number of the winding spindle of the operated reed relay as the same as the number of the winding spindle indicated by the BCD code signal.

III. detection of bobbin replacement;

The replacement of the bobbins is detected when at least one bobbin shutter in one section has been opened so as to turn on the photoelectric switch 23 of the receiver 16. The output of the photoelectric switch 23 is supplied to the data buffer 25 through a data buffer 36. In this case, the data buffer 36 is reset by a yarn splicing completion signal from the negative edge trigger circuit 31. Thus, the number of the winding spindle the bobbin for which has been replaced is not required to be known since the number of the winding spindle the bobbin for which was replaced is the same as the number of the winding spindle for which the yarn was spliced.

IV. loading and transmitting of data from data buffer;

As described hereinabove, the data buffer 25 has therein six bits (in total) of a code signal, which corresponds to the BCD code signal of the winding spindle the yarn of which is being spliced, a yarn cutting detecting signal, and a bobbin-replacement detecting signal. For example, when the yarn is being spliced as a result of bobbin replacement at a third winding spindle, the code signal stored is "100011".

This code signal is transmitted in series, through the multiplexer 41, from the parallel-to-serial converter 40-S1, ... 40-S5 to the serial-to-parallel converter 42. The multiplexer 41 selects in a multiplexing manner the code signal corresponding to the winding machine number. The computer 45 processes code signals from the input register and counts yarn splicing operations, yarn cutting operations and bobbin replacement operations respectively for each machine, each section and each winding spindle, continuously during a initially-set time period, according to the data which is supplied.

This data is transmitted repeatedly at a proper sampling interval in so-called non-synchronous relation to setting and resetting timing of the data buffer 25 and, therefore, reliability of the transmission signal is greatly increased.

V. detection of yarn splicing operations due to abnormal causes by winding spindles;

Abnormal reasons for yarn splicing can be detected by detecting whether or not the yarn splicing is effected due to the yarn cutting or the bobbin replacement when the yarn splicing has been carried out. Printing may be performed whenever an abnormal reason for yarn splicing is detected. Normally, the frequencies can be obtained by $$S(i, j, k) = N(i, j, k) - \{a(i, j, k) + b(i, j, k)\}$$

wherein $N(i, j, k)$ is the yarn splicing operations (in total; $a(i, j, k)$ being the yarn cutting operations; $b(i, j, k)$ being the bobbin replacement operations, in a given time period of, for example, $k$-th winding spindle, $j$-th section, the $i$-th winding machine; and $S(i,$ the $j,$ the $k)$ being the yarn splicing operations, due to abnormal causes, of the winding spindle.

When the ratio of the yarn splicing operations $S(i, j, k)$ due to the abnormal causes to the total yarn splicing operations, $N(i, j, k)$, is large, the operation of the winding spindle should be stopped to check for the causes of the failures and for correcting the causes. Needless to say, the above data can be processed by various statistical techniques to apply the data to the controlling of all the winding machines, the controlling of quality, etc.

As is apparent from the above detailed description, the present invention provides a controlling method and apparatus wherein the yarn splicing operation of the automatic knotting machine which is provided in an automatic winding machine is analyzed for each of the winding spindles and makes it possible to check whether or not mechanical failures, etc. have occurred at each winding spindle so as to provide a complete single-spindle controlling operation, the data from each single-spindle being used to provide a smooth and positive control of all the spindles.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is

1. A method of counting yarn splicing operations due to normal and abnormal reasons in an automatic winding machine provided with a plurality of winding spindles and an automatic knotting machine circulating past said spindles for carrying out yarn splicing at each of said spindles when necessary, comprising the steps of detecting the operation of a slub catcher associated with each winding spindle and counting the number of operations as an indication of the number of yarn cuttings, detecting the occurrence of bobbin replacement for each winding spindle and counting the number of bobbin replacements, counting for each spindle the total number of the yarn splicing operations, and subtracting from the total number of yarn splicing operations the number of yarn cuttings and bobbin replacements for determining the number of yarn splicing operations due to causes other than the normal causes of yarn cuttings and bobbin replacements.

2. A method for counting yarn splicing operations as claimed in claim 1 wherein said step of detecting the occurrence of bobbin replacement for the respective spindles comprises the step of detecting the operation of a bobbin shutter disposed in front of the bobbin.

3. In an automatic winding machine provided with a plurality of winding spindles each having associated therewith a slub catcher and a bobbin replacing means, and an automatic knotting machine circulating past said spindles for carrying out yarn splicing at each of said spindles when necessary, an apparatus for counting yarn splicing operations due to normal and abnormal reasons for each of said spindles, comprising: yarn splicing detecting means for detecting the occurrence of a yarn splicing operation at each spindle and including a reed switch associated with each spindle for producing a yarn splicing detecting signal when closed for longer than a predetermined time and a magnet secured to the automatic knotting machine for operating the respective reed switches; a yarn cutting detecting means for each spindle for detecting the occurrences of yarn cutting by detecting the operation of the slub catcher for the spindle and producing a yarn cutting detecting signal; a bobbin replacement detecting means coupled to said yarn splicing detecting means for producing a bobbin replacement signal when the operation of said bobbin replacing means occurs simultaneously with the yarn splicing detecting signal; and a data processor coupled to the respective detecting means for counting the operations for the respective spindles and comparing them for determining the number of splicing operations for the respective spindles due to causes other than bobbin replacement and yarn cutting by the slub catchers.

4. An apparatus as claimed in claim 3 wherein said yarn cutting detecting means comprises reed relays associated with the respective slub catchers and operated by the operating instruction for the slub catcher.

5. An apparatus as claimed in claim 3 wherein said bobbin replacement detecting means comprises a means for generating a detection signal upon the optical detection of the operation of a bobbin shutter.

6. An apparatus as claimed in claim 3 wherein said data processor comprises a counting means having a signal converter for converting the yarn splicing detecting signal into a BCD code signal corresponding to the number of the winding spindles, and for reading the yarn cutting detecting signal and the bobbin replacing signal in response to the number of the winding spindle specified by the BCD code signal for individual counting the number of yarn splicings, the number of yarn cuttings, and the number of bobbin replacements.

* * * * *